US007486915B2

(12) United States Patent
Koyama et al.

(10) Patent No.: US 7,486,915 B2
(45) Date of Patent: Feb. 3, 2009

(54) TONER CARTRIDGE AND IMAGE FORMING APPARATUS TO BE MOUNTED WITH THE TONER CARTRIDGE

(75) Inventors: Kazuya Koyama, Ikoma (JP); Masanobu Deguchi, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 390 days.

(21) Appl. No.: 11/348,327

(22) Filed: Feb. 7, 2006

(65) Prior Publication Data

US 2006/0182469 A1 Aug. 17, 2006

(30) Foreign Application Priority Data

Feb. 14, 2005 (JP) ..... 2005-036418

(51) Int. Cl.
*G03G 15/08* (2006.01)

(52) U.S. Cl. ..... 399/258; 399/262

(58) Field of Classification Search ..... 399/120, 399/258, 262
See application file for complete search history.

(56) References Cited

U.S. PATENT DOCUMENTS

| | | | | |
|---|---|---|---|---|
| 5,655,180 | A * | 8/1997 | Yasuda et al. | 399/106 |
| 5,848,338 | A * | 12/1998 | Okada | 399/262 |
| 6,256,470 | B1 * | 7/2001 | Taniyama et al. | 399/262 |
| 6,298,208 | B1 * | 10/2001 | Kawamura et al. | 399/262 |

FOREIGN PATENT DOCUMENTS

| | | |
|---|---|---|
| CN | 1159616 | 9/1997 |
| JP | 56-130776 A | 10/1981 |
| JP | 6-59576 A | 3/1994 |
| JP | 09-43960 | 2/1997 |
| JP | 2000-172061 | 6/2000 |
| JP | 2001-222158 | 8/2001 |
| JP | 2001-235935 | 8/2001 |
| JP | 2002-351203 | 12/2002 |
| JP | 2003-255684 | 9/2003 |
| JP | 2003-315138 | 11/2003 |
| JP | 2004-325840 | 11/2004 |
| JP | 2005-92240 | 4/2005 |

* cited by examiner

*Primary Examiner*—David M Gray
*Assistant Examiner*—Bryan Ready
(74) *Attorney, Agent, or Firm*—Nixon & Vanderhye P.C.

(57) ABSTRACT

A toner cartridge is provided, which comprises a toner bottle containing toner, and a support member supporting the toner bottle in an axially rotatable manner. The toner bottle has a toner outlet port provided in a portion thereof supported by the support member. The support member has an outlet port shutter provided slidably on an outer surface thereof for opening and closing the toner outlet port, and a projecting engagement portion for positioning the toner cartridge with respect to a cartridge insertion port of an image forming apparatus when the toner cartridge is mounted in the image forming apparatus. The support member and the toner bottle respectively have a projection and a recess serving as a locking portion and a to-be-locked portion for restricting rotation of the toner bottle with respect to the support member when the toner cartridge is not mounted in the image forming apparatus.

12 Claims, 10 Drawing Sheets

TONER CARTRIDGE AND IMAGE FORMING APPARATUS TO BE MOUNTED WITH THE TONER CARTRIDGE

CROSS-REFERENCE TO RELATED APPLICATIONS

This application is related to Japanese application No. 2005-036418 filed on Feb. 14, 2005, whose priority is claimed under 35 USC § 119, the disclosure of which is incorporated by reference in its entirety.

BACKGROUND OF THE INVENTION

1. Field of the Invention

The present invention relates to a toner cartridge and an image forming apparatus to be mounted with the toner cartridge.

2. Description of the Related Art

A toner cartridge of the prior art essentially includes a toner bottle having a toner outlet port and an outlet port shutter, and a rotation member attached to the toner bottle in a rotatable manner (see, for example, Japanese Unexamined Patent Publication No. 2003-316138). When the toner cartridge is inserted into an image forming apparatus along its length, the toner bottle is unlocked from the rotation member, and a gear of the rotation member is engaged with a gear of a developing device of the image forming apparatus. When an user thereafter rotates the rotation member in a predetermined direction, the outlet port shutter of the toner bottle coupled to the gear and an inlet port shutter of the developing device coupled to the outlet port shutter are simultaneously opened.

Image forming apparatuses such as a copying machine, a facsimile machine and a printer utilizing an electrophotographic system typically include a photosensitive drum on which an electrostatic latent image is formed by laser irradiation means or the like, and a developing device provided in the vicinity of the photosensitive drum for developing the electrostatic latent image with toner. In such an image forming apparatus, a toner cartridge is removably mounted for supplying the toner to the developing device.

Where the developing device employs a two-component developing agent containing a toner and a carrier such as iron powder, for example, the toner and the carrier are stirred to be homogeneously mixed in a stirring chamber, and the resulting two-component developing agent is transported to the vicinity of a developing roller incorporating a magnetic member.

The developing agent transported to the vicinity of the developing roller is carried on a surface of the developing roller by a magnetic field of the developing roller to provide a so-called magnetic brush. When the magnetic brush is brought into opposed relation to the photosensitive drum, only negatively charged toner is transferred onto the photosensitive drum to develop the electrostatic latent image. When the carrier separated from the toner thereafter passes through a repulsive magnetic field of the developing roller, the carrier falls back into the stirring chamber of the developing device.

Therefore, the toner concentration of the developing agent in the developing device is gradually reduced during repeated image formation. When the toner concentration is reduced to a predetermined concentration level, the reduction is detected by a sensor provided in the developing device. In response to the detection, a toner bottle of the toner cartridge is rotatively driven, whereby the toner is supplied to the developing device from a toner outlet port of the toner bottle. When the toner concentration is recovered to the predetermined concentration level, the driving of the toner bottle is stopped.

The amount of the toner in the toner bottle is also reduced during repeated supply of the toner. When the toner bottle is substantially emptied, a message for replacement of the toner cartridge is displayed on an operation panel of the image forming apparatus or the like to prompt a user to replace the toner cartridge.

Since the toner is very fine powder, a very small amount of toner remains in the toner bottle substantially emptied. Therefore, the toner bottle is not completely emptied. In order to prevent the toner from leaking from the toner outlet port in the replacement of the toner cartridge, the toner cartridge generally has a shutter of a certain configuration provided on the toner outlet port.

In the case of the toner cartridge disclosed in Japanese Unexamined Patent Publication No. 2003-316138, the toner bottle is unlocked from the rotation member and the gear of the rotation member is engaged with the gear of the developing device by the insertion of the toner cartridge, and then the rotation member is rotated in a predetermined direction to simultaneously open the outlet port shutter coupled to the gear and the inlet port shutter coupled to the outlet port shutter. However, the opening and closing of the shutters is achieved by the engagement of the gears. This complicates the construction, and increases the costs. Where the toner cartridge is frequently mounted and demounted, the durability of the gears is unsatisfactory.

The engagement of the gears for the opening and closing of the shutters does not give a positive tactile feedback to the user, even if the toner cartridge is properly mounted with the shutters being fully opened by the operation of the rotation member. If the user fails to recognize that the toner cartridge is properly mounted, the user will make an attempt to further rotate the rotation member to break the gears and the like.

SUMMARY OF THE INVENTION

In view of the foregoing, it is an object of the present invention to provide a toner cartridge which is capable of assuredly and easily performing an unlocking operation and shutter opening and closing operations with a simple construction and giving a positive tactile feedback to an user when the toner cartridge is properly mounted, and to provide an image forming apparatus to be mounted with the toner cartridge.

According to the present invention, there is provided a toner cartridge to be removably mounted in an image forming apparatus including a cartridge insertion port for receiving the toner cartridge. The toner cartridge comprises a toner bottle which contains toner, and a support member which supports the toner bottle in an axially rotatable manner. The toner bottle has a toner outlet port provided in a portion thereof supported by the support member. The support member has an outlet port shutter provided slidably on an outer surface thereof for opening and closing the toner outlet port, and a projecting engagement portion for positioning the toner cartridge with respect to the cartridge insertion port in the mounting of the toner cartridge. The support member and the toner bottle respectively have a projection and a recess serving as a locking portion and a to-be-locked portion for restricting rotation of the toner bottle with respect to the support member when the toner cartridge is not mounted in the image forming apparatus.

According to the present invention, the cartridge insertion port of the image forming apparatus includes a toner inlet port provided in an inner wall surface thereof for receiving toner supplied from the toner cartridge, an inlet port shutter provided slidably on the toner inlet port for opening and closing the toner inlet port, a resilient member which biases the toner cartridge in a direction opposite from a toner cartridge insertion direction, and a disengaging member which acts on the locking portion to disengage the locking portion from the to-be-locked portion in the mounting of the toner cartridge. Further, the cartridge insertion port has a pivot groove in which the engagement portion is pivoted, a to-be-engaged portion to be engaged with the pivoted engagement portion, and a latching portion which latches a part of the outlet port shutter. In this case, when the inventive toner cartridge is inserted into the cartridge insertion port, the inlet port shutter of the image forming apparatus is pushed and slid in engagement with a part of the support member thereby to be opened, and the part of the outlet port shutter of the toner cartridge is latched by the latching portion of the cartridge insertion port. Further, the outlet port shutter latched in the cartridge insertion port is slid relative to the support member to be opened by rotating the support member by a predetermined angle in a predetermined direction while pushing the toner cartridge to an innermost end of the cartridge insertion port against a biasing force of the resilient member. Thus, the simplification of the construction and the reduction of the costs can be achieved, and the simplified construction ensures improved structural reliability.

When the engagement portion is moved to a position associated with the to-be-engaged portion of the cartridge insertion port by rotating the support member by the predetermined angle in the predetermined direction after inserting the toner cartridge to the innermost end against the biasing force of the resilient member, the toner cartridge is moved in the direction opposite from the insertion direction by the biasing force of the resilient member, whereby the toner cartridge is properly positioned with the engagement portion in engagement with the to-be-engaged portion. Therefore, a positive tactile feedback is given to an user, who in turn recognizes that the toner cartridge is properly mounted. This affords a sense of ease to the user, and prevents the user from performing an unreasonable operation.

Since the toner cartridge can be mounted simply by rotating the support member by the predetermined angle in the predetermined direction while pushing the toner cartridge to the innermost end of the cartridge insertion port against the biasing force of the resilient member, the cartridge mounting operation is very simple.

In the mounting of the toner cartridge, the inlet port shutter of the image forming apparatus is opened, and then the outlet port shutter of the toner cartridge is opened. In the demounting of the toner cartridge, the outlet port shutter of the toner cartridge is closed, and then the inlet port shutter of the image forming apparatus is closed. Therefore, the leak of the toner in the image forming apparatus can be minimized.

Since gears and the like are not required for the opening and closing of the shutter, the toner cartridge has an advantageously reduced size.

BRIEF DESCRIPTION OF THE DRAWINGS

FIG. 2 is inserted in the cartridge insertion port shown FIG. 4;

FIG. 2 is inserted into the cartridge insertion port shown FIG. 4;

FIG. 2 is taken out of the cartridge insertion port shown FIG. 4.

DESCRIPTION OF THE PREFERRED EMBODIMENTS

Figure 1:
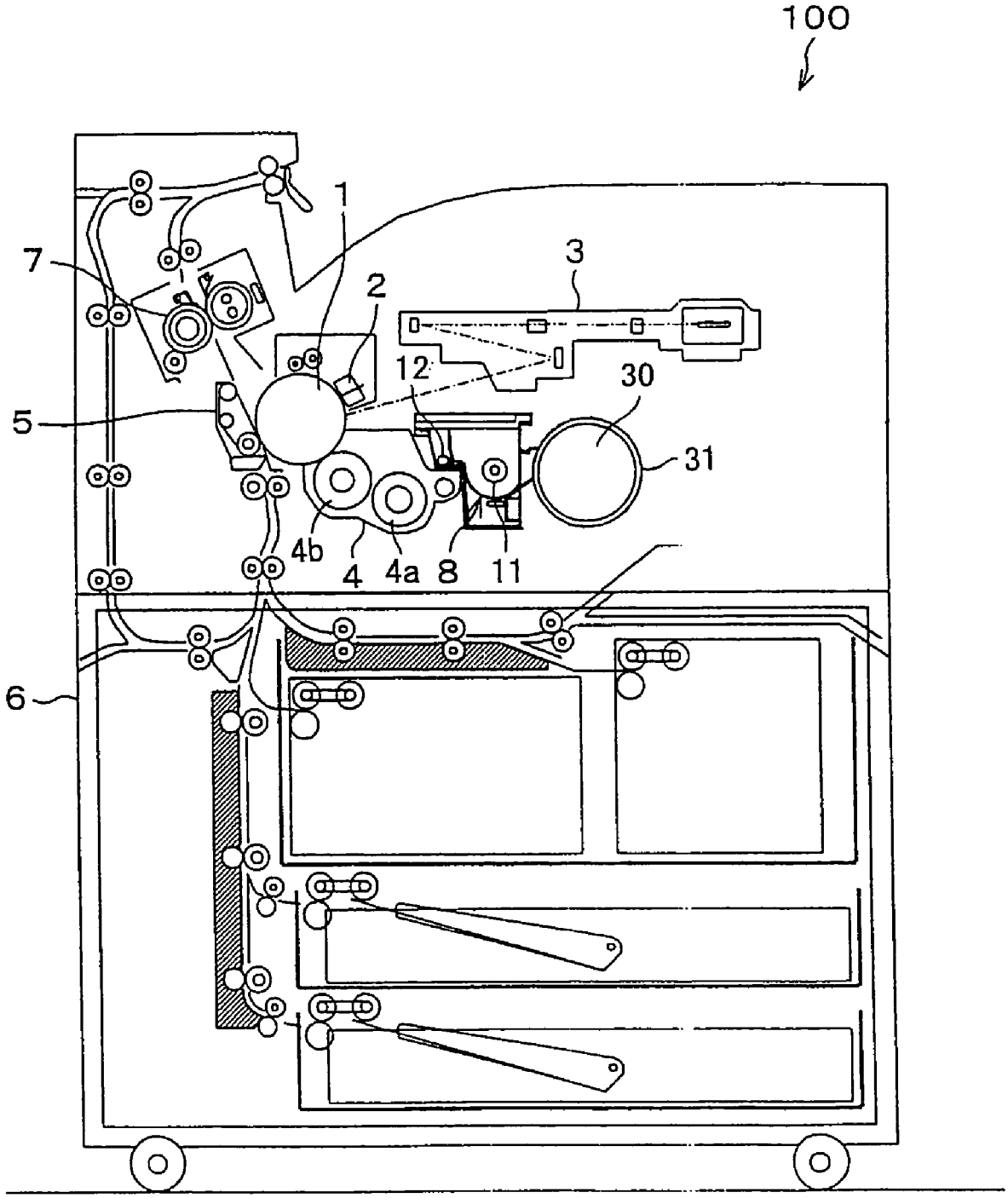
FIG. 1 is a schematic diagram illustrating the construction of a copying machine according to an embodiment of the present invention and a toner cartridge according to an embodiment of the present invention.

According to the present invention, a toner cartridge to be removably mounted in an image forming apparatus including a cartridge insertion port for receiving the toner cartridge comprises a toner bottle which contains toner, and a support member which supports the toner bottle in an axially rotatable manner.

In the present invention, the cartridge insertion port means a region of the image forming apparatus in which the toner cartridge is mounted.

The image forming apparatus to be mounted with the toner cartridge is capable of forming an image with the use of a toner, and the type of the image forming apparatus is not particularly limited. Examples of the image forming apparatus include a copying machine and a facsimile machine of an electrophotographic system.

The toner bottle means a container which contains the toner. The toner bottle is axially rotatable, and has a toner outlet port provided in a portion thereof supported by the support member. The toner bottle has one of a projection and a recess which respectively serve as a locking portion and a to-be-locked portion for restricting the rotation of the toner bottle with respect to the support member when the toner cartridge is not mounted. The structure of the toner bottle is not particularly limited. The toner bottle is formed of, for example, a soft resilient resin such as a polyethylene resin by a blow molding method.

The support member means a member which supports the toner bottle in an axially rotatable manner. The support member is capable of supporting the toner bottle in an axially rotatable manner. The support member has an outlet port shutter provided slidably on an outer surface thereof for opening and closing the toner outlet port, a projecting engagement portion for positioning the toner cartridge with respect to the cartridge insertion port, and the other of the projection and the recess which respectively serve as the locking portion and the to-be-locked portion for restricting the rotation of the toner bottle with respect to the support member when the toner cartridge is not mounted. The structure of the support member is not particularly limited. The support member is molded from a polyacetal (POM) resin or an acrylonitrile-butadiene-styrene (ABS) resin which is highly elastic and shock-resistant.

In the inventive toner cartridge, the support member may be a cylindrical member covering one end portion of the toner bottle, and the engagement portion may project outward from a peripheral surface of the support member and extend in a toner cartridge insertion direction.

In the inventive toner cartridge, the engagement portion may have a linear projection provided on a surface thereof as extending in the toner cartridge insertion direction. In this case, the cartridge insertion port preferably has a groove which receives the linear projection.

With this arrangement, when the toner cartridge is inserted into the cartridge insertion port, the position and orientation of the toner cartridge with respect to the cartridge insertion port is forcibly restricted, so that the user is prevented from inserting the toner cartridge in a wrong position in a wrong orientation.

Where the image forming apparatus is a color copying machine, plural types of toner cartridges (i.e., Y (yellow), M (magenta), C (cyan) and K (black) toner cartridges) should be respectively set in predetermined cartridge insertion ports. By providing linear projections at different positions on the respective toner cartridges and providing grooves at correspondingly different positions in the respective cartridge insertion ports, erroneous insertion of these toner cartridges can be prevented. Thus, the toner cartridges can be assuredly respectively mounted in the predetermined cartridge insertion ports.

In an image forming apparatus mounted with a single toner cartridge (e.g., a monochrome copying machine), the positions of the linear projection and the groove may be varied depending on the model of the image forming apparatus, whereby the image forming apparatus is prevented from being mounted with a toner cartridge unsuitable for the model of the image forming apparatus.

In the aforesaid arrangement with the linear projection provided on the engagement portion, the linear projection may have a taper face which has a height progressively increasing in the toner cartridge insertion direction. In this case, the cartridge insertion port preferably includes a resilient member which biases the toner cartridge in a direction opposite from the insertion direction, and has a pivot groove in which the engagement portion is pivoted and a to-be-engaged portion to be engaged with the pivoted engagement portion. The to-be-engaged portion preferably has an inclined face provided in association with the taper face of the linear projection so as to be brought into intimate contact with the taper face when being engaged with the engagement portion.

With this arrangement, when the support member is rotated by a predetermined rotation angle in a predetermined direction, the engagement portion is moved to a position associated with the to-be-engaged portion, and the toner cartridge is moved in the direction opposite from the insertion direction by the biasing force of the resilient member. At this time, the engagement portion is smoothly guided to the to-be-engaged portion by the taper face of the linear projection of the engagement portion and the inclined face of the to-be-engaged portion associated with the taper face, whereby the engagement portion is engaged with the to-be-engaged portion at a higher level of positioning accuracy.

In the inventive toner cartridge, the support member may have a first outlet port shutter rail and a second outlet port shutter rail for sliding the outlet port shutter. The first and second outlet port shutter rails preferably each extend perpendicularly to the toner cartridge insertion direction. The first outlet port shutter rail may be disposed inward of the second outlet port shutter rail with respect to the toner cartridge insertion direction, and have a greater length than a movable range of the outlet port shutter. In this case, the cartridge insertion port preferably includes a toner inlet port provided in an inner wall surface thereof for receiving the toner supplied from the toner cartridge, and an inlet port shutter provided slidably on the toner inlet port for opening and closing the toner inlet port.

With this arrangement, the longer first outlet port shutter rail abuts against the inlet port shutter to push and open the inlet port shutter when the toner cartridge is inserted.

In the aforesaid arrangement with the first and second outlet port shutter rails provided on the support member, the first outlet port shutter rail may have an engagement projection provided on an inner edge thereof with respect to the toner cartridge insertion direction. In this case, the inlet port shutter preferably has an engagement groove provided on an outer edge thereof with respect to the toner cartridge insertion direction for releasable engagement with the engagement projection of the first outlet port shutter rail.

With this arrangement, the first outlet port shutter rail can be smoothly engaged with the inlet port shutter when the toner cartridge is inserted, and smoothly disengaged from the inlet port shutter when the toner cartridge is taken out.

In the inventive toner cartridge, the locking portion may be provided on the support member, and the to-be-locked portion may be provided on the toner bottle. The locking portion may include a lock pin to be fitted in the to-be-locked portion of the toner bottle and a wedge-shaped action portion which vertically moves the lock pin. In this case, the cartridge insertion port preferably includes a wedge-shaped disengaging member which is inserted below the action portion when the support member is rotated.

With this arrangement, the locking portion can be disengaged from the to-be-locked portion with a simple structure, thereby reducing the costs and improving the structural reliability.

According to another aspect of the present invention, there is provided an image forming apparatus, which comprises a cartridge insertion port for receiving a toner cartridge which includes a toner bottle containing toner and a support member supporting the toner bottle in an axially rotatable manner. The toner bottle has a toner outlet port provided in a portion thereof supported by the support member. The support member has an outlet port shutter provided slidably on an outer surface thereof for opening and closing the toner outlet port, and a projecting engagement portion for positioning the toner cartridge with respect to the cartridge insertion port in mounting the toner cartridge. The support member and the toner bottle respectively have a projection and a recess serving as a locking portion and a to-be-locked portion for restricting rotation of the toner bottle with respect to the support member when the toner cartridge is not mounted in the image forming apparatus. The cartridge insertion port includes a toner inlet port provided in an inner wall surface thereof for receiving toner supplied from the toner cartridge, an inlet port shutter provided slidably on the toner inlet port for opening and closing the toner inlet port, a resilient member which biases the toner cartridge in a direction opposite from a toner cartridge insertion direction, and a disengaging member which acts on the locking portion to disengage the locking portion from the to-be-locked portion in the mounting of the toner cartridge. The cartridge insertion port has a pivot groove in which the engagement portion is pivoted, a to-be-engaged portion to be engaged with the pivoted engagement portion, and a latching portion which latches a part of the outlet port shutter. When the toner cartridge is inserted into the cartridge insertion port, the inlet port shutter is pushed and slid in releasable engagement with a part of the support member to open the toner inlet port, and the part of the outlet port shutter is latched by the latching portion of the cartridge insertion port. When the toner cartridge is pushed into an innermost end of the cartridge insertion port against a biasing force of the resilient member and the support member is rotated by a predetermined angle in a predetermined direction with respect to the cartridge insertion port, the disengaging member acts on the locking portion to disengage the locking portion from the to-be-locked portion, whereby the outlet port shutter latched by the latching portion is moved relative to the support member to open the toner outlet port and the engagement portion is pivoted in the pivot groove of the cartridge insertion port to a position associated with the to-be-engaged portion. When the toner cartridge is moved in the direction opposite from the insertion direction by the biasing force of the resilient member, the engagement portion is engaged with the to-be-engaged portion to position the toner cartridge in the cartridge insertion port.

The inventive image forming apparatus provides the same effects as the aforesaid inventive toner cartridge.

In the inventive image forming apparatus, the engagement portion preferably has a linear projection provided on a surface thereof as extending in the toner cartridge insertion direction, and the cartridge insertion port preferably has a groove for receiving the linear projection. This arrangement is advantageous for the reasons described with reference to the inventive toner cartridge.

In the aforesaid arrangement where the toner cartridge and the cartridge insertion port respectively have the linear projection and the groove, the linear projection preferably has a taper face which has a height progressively increasing in the toner cartridge insertion direction, and the to-be-engaged portion preferably has an inclined face provided in association with the taper face of the linear projection so as to be brought into intimate contact with the taper face when being engaged with the engagement portion. This arrangement is advantageous for the reasons described with reference to the inventive toner cartridge.

In the inventive image forming apparatus, the support member preferably has a first outlet port shutter rail and a second outlet port shutter rail for sliding the outlet port shutter. The first and second outlet port shutter rails preferably each extend perpendicularly to the toner cartridge insertion direction. The first outlet port shutter rail is preferably disposed inward of the second outlet port shutter rail with respect to the toner cartridge insertion direction, and preferably has a greater length than a movable range of the outlet port shutter. The first outlet port shutter rail preferably has an engagement projection provided on an inner edge thereof with respect to the toner cartridge insertion direction, and the inlet port shutter preferably has an engagement groove provided on an outer edge thereof with respect to the toner cartridge insertion direction for releasable engagement with the engagement projection of the first outlet port shutter rail. This arrangement is advantageous for the reasons described with reference to the toner cartridge.

In the inventive image forming apparatus, the locking portion is preferably provided on the support member, and the to-be-locked portion is preferably provided on the toner bottle. The locking portion preferably includes a lock pin to be fitted in the to-be-locked portion of the toner bottle through the support member, and a wedge-shaped action portion which vertically moves the lock pin. The disengaging member preferably has a wedge-shape so as to be inserted below the action portion when the support member is rotated. This arrangement is advantageous for the reasons described with reference to the toner cartridge.

With reference to the attached drawings, the present invention will hereinafter be described in detail by way of an embodiment thereof.

A toner cartridge and an image forming apparatus according to the embodiment of the present invention will be described with reference to FIGS. 1 to 10.

Figure 2:
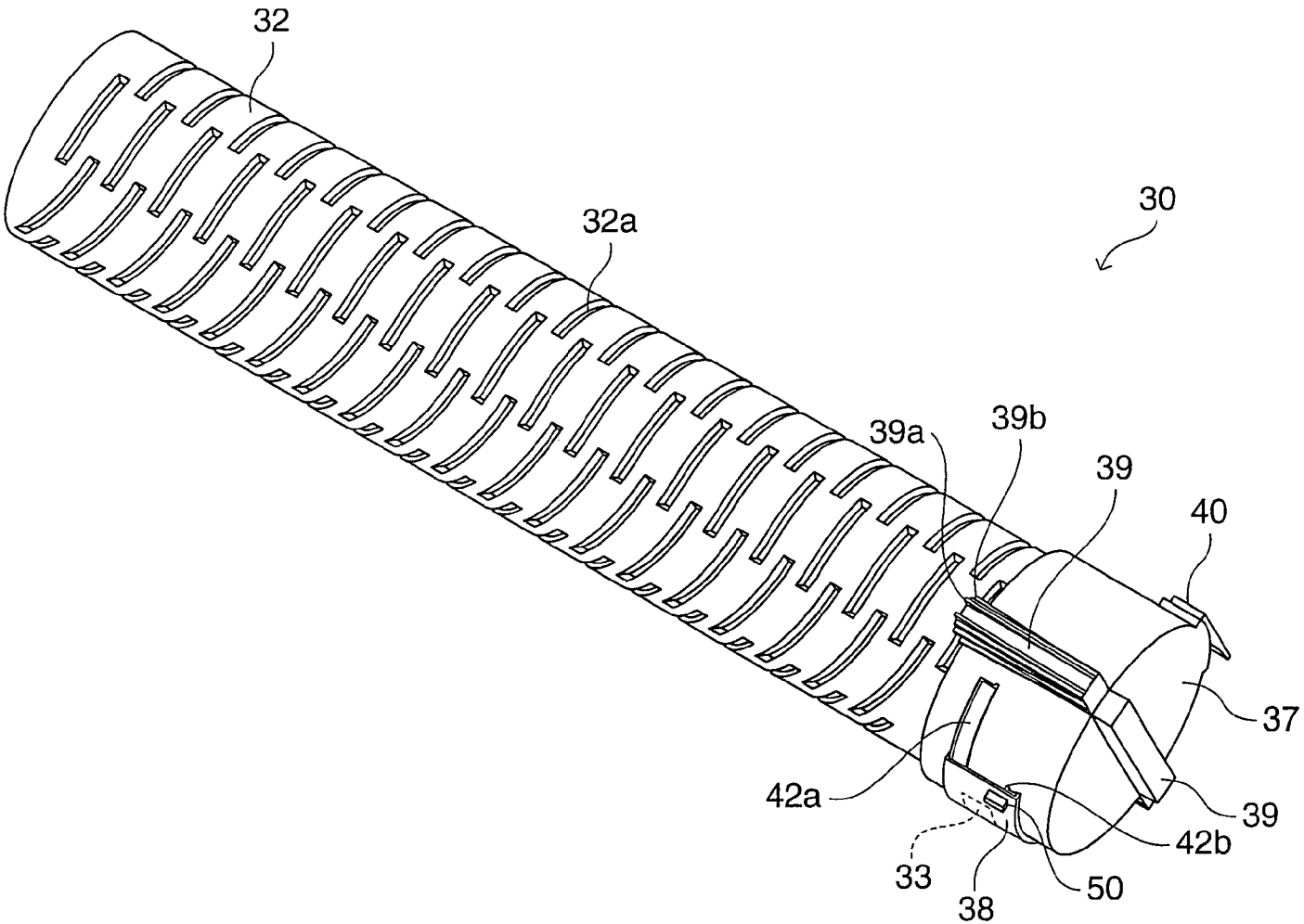
FIG. 2 is a perspective view of the toner cartridge according to the above embodiment.
Figure 3:
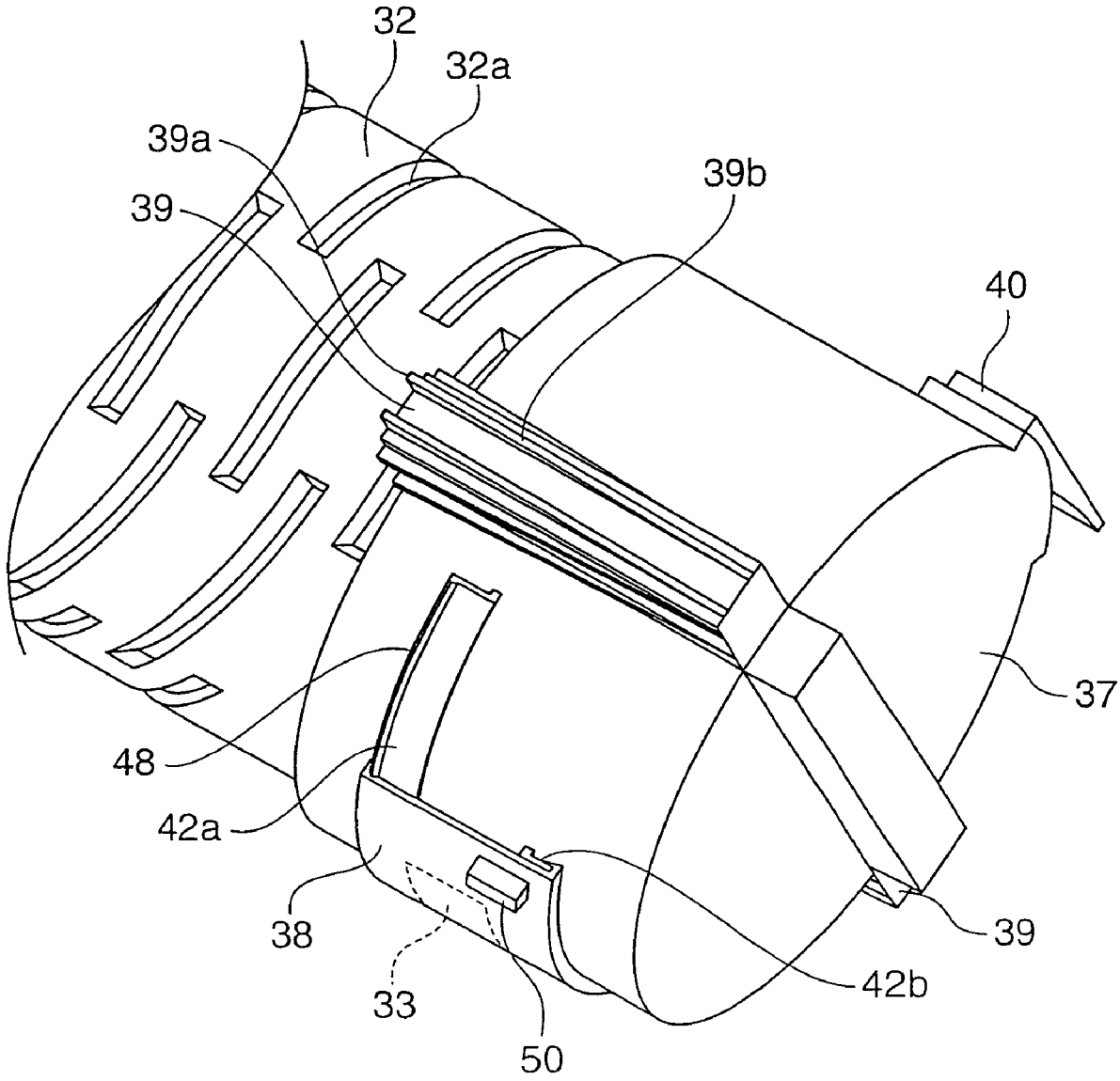
FIG. 3 is an enlarged view of major portions of the toner cartridge shown in FIG. 2.
Figure 4:
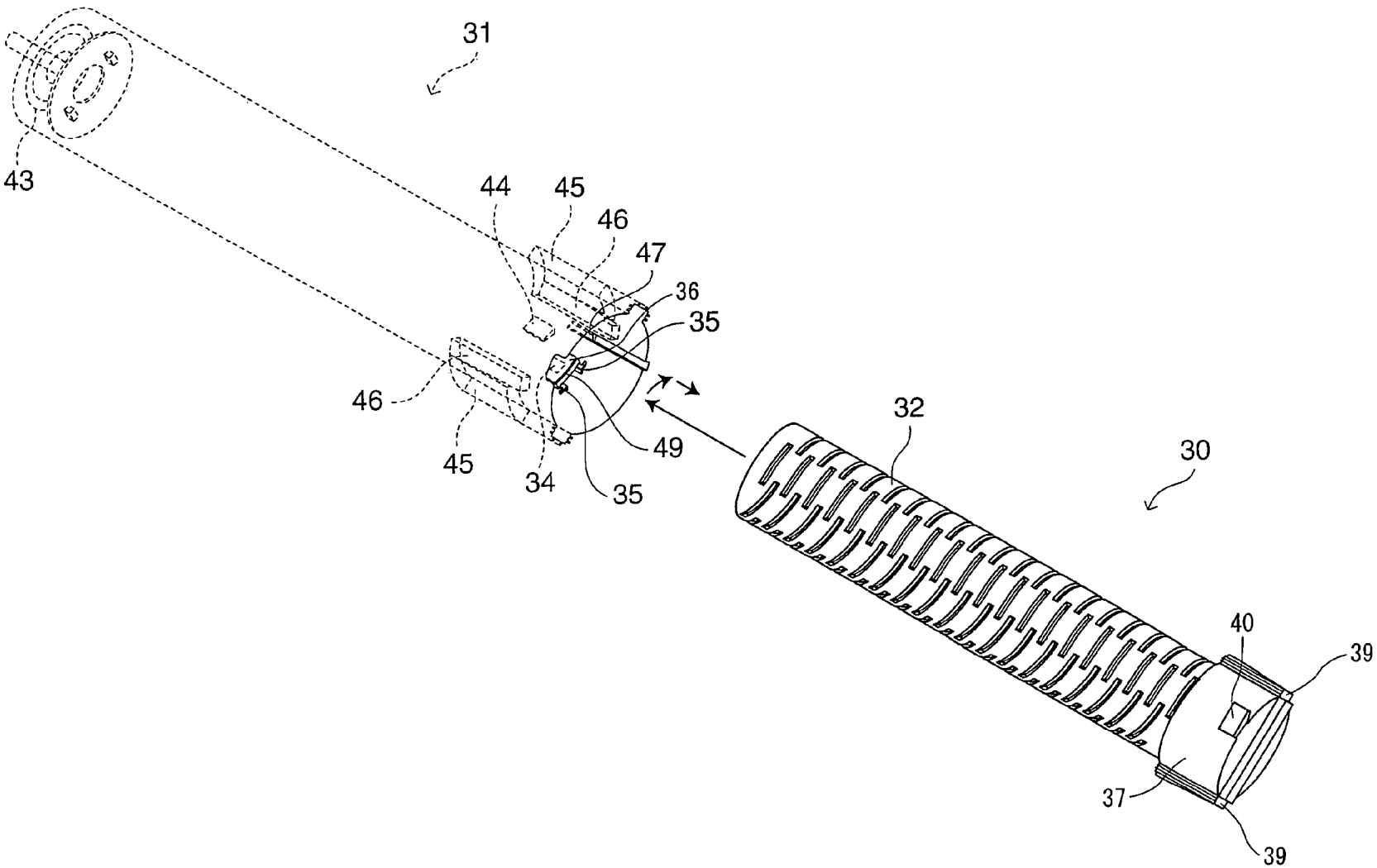
FIG. 4 is a perspective view illustrating a relationship between the toner cartridge shown FIG. 2 and a cartridge insertion port of the copying machine shown FIG. 1.
Figure 5:
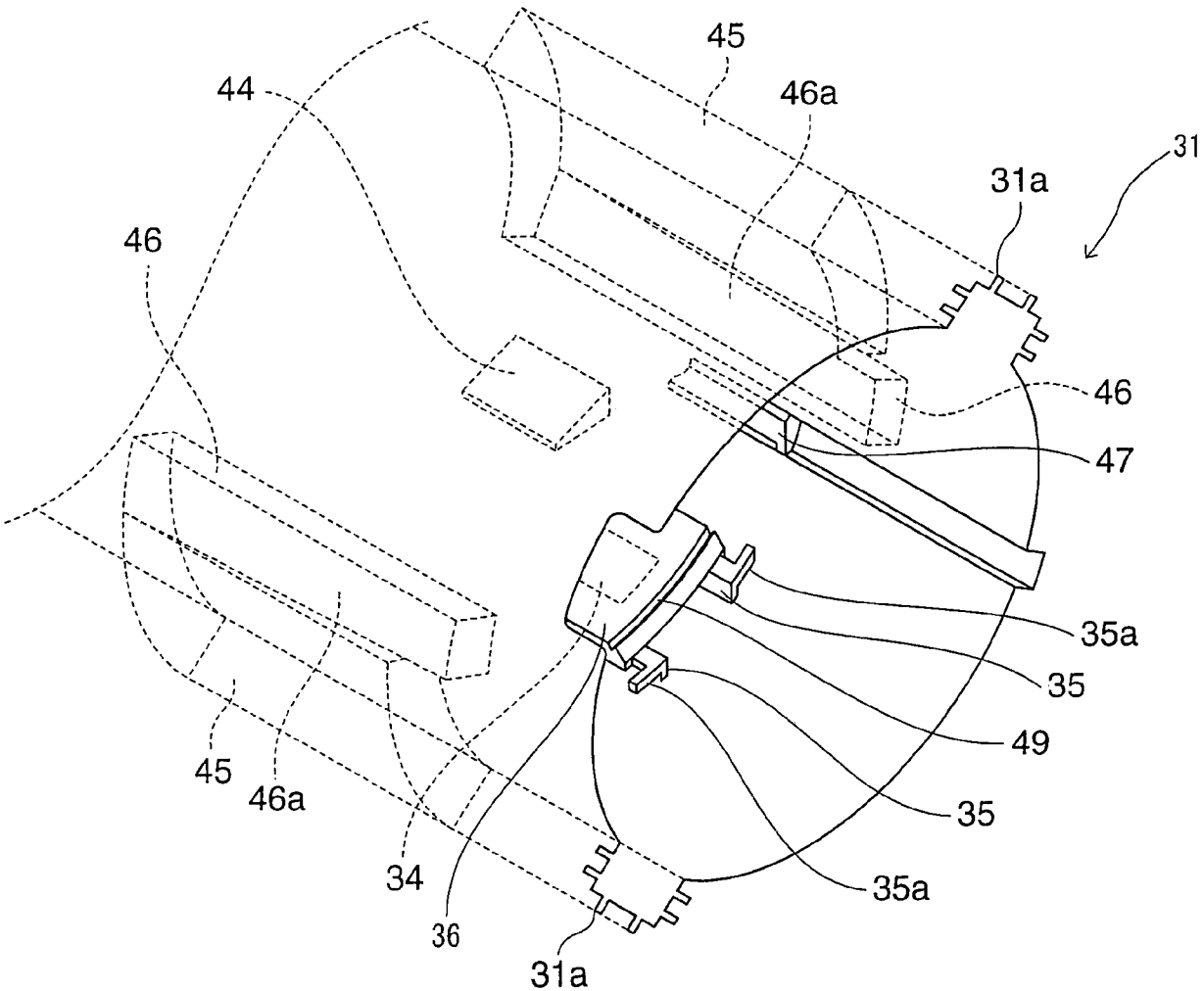
FIG. 5 is an enlarged view illustrating the cartridge insertion port shown in FIG. 4.
Figure 6:
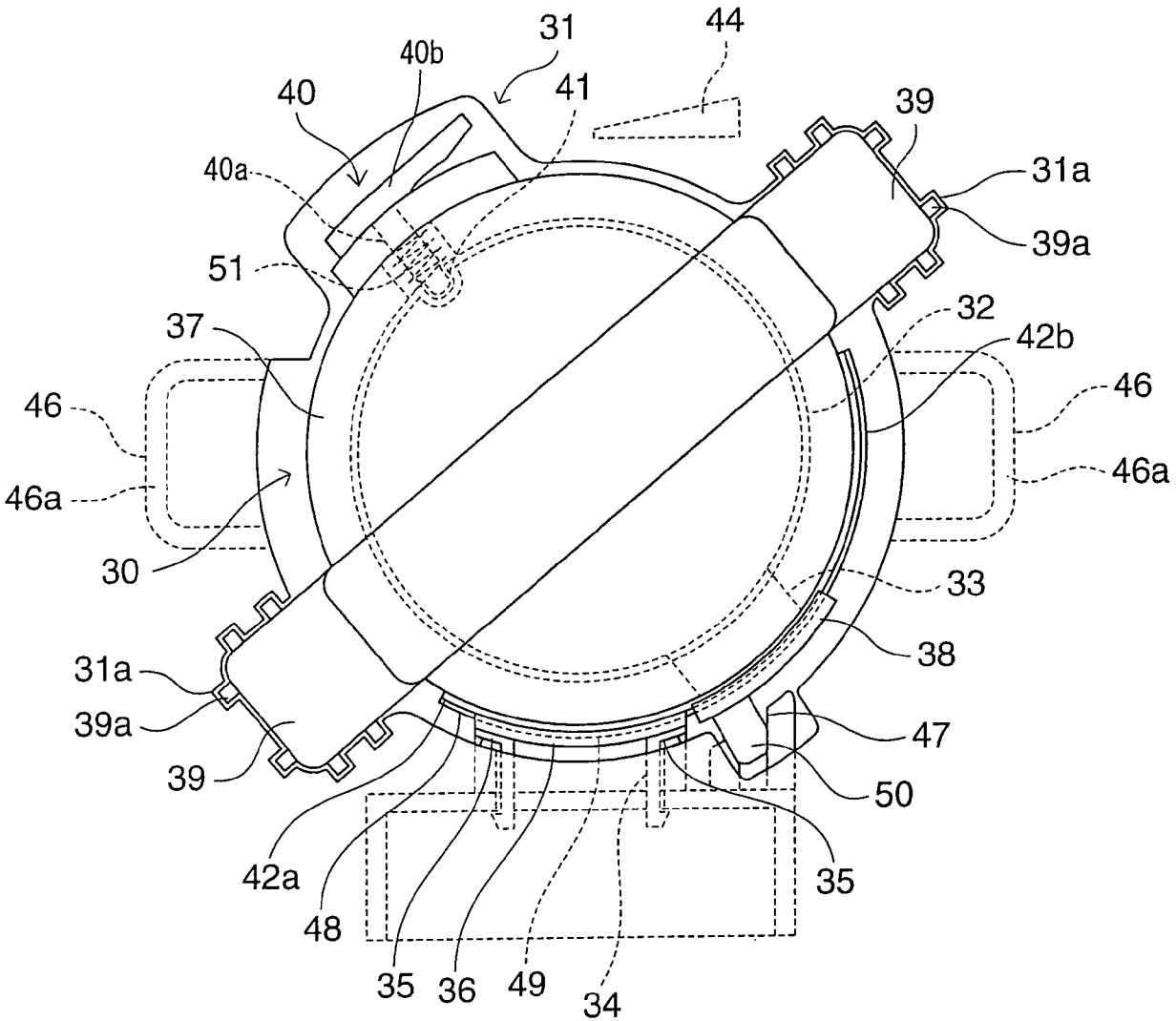
FIG. 6 is a front view illustrating a state in which the toner cartridge shown
Figure 7:
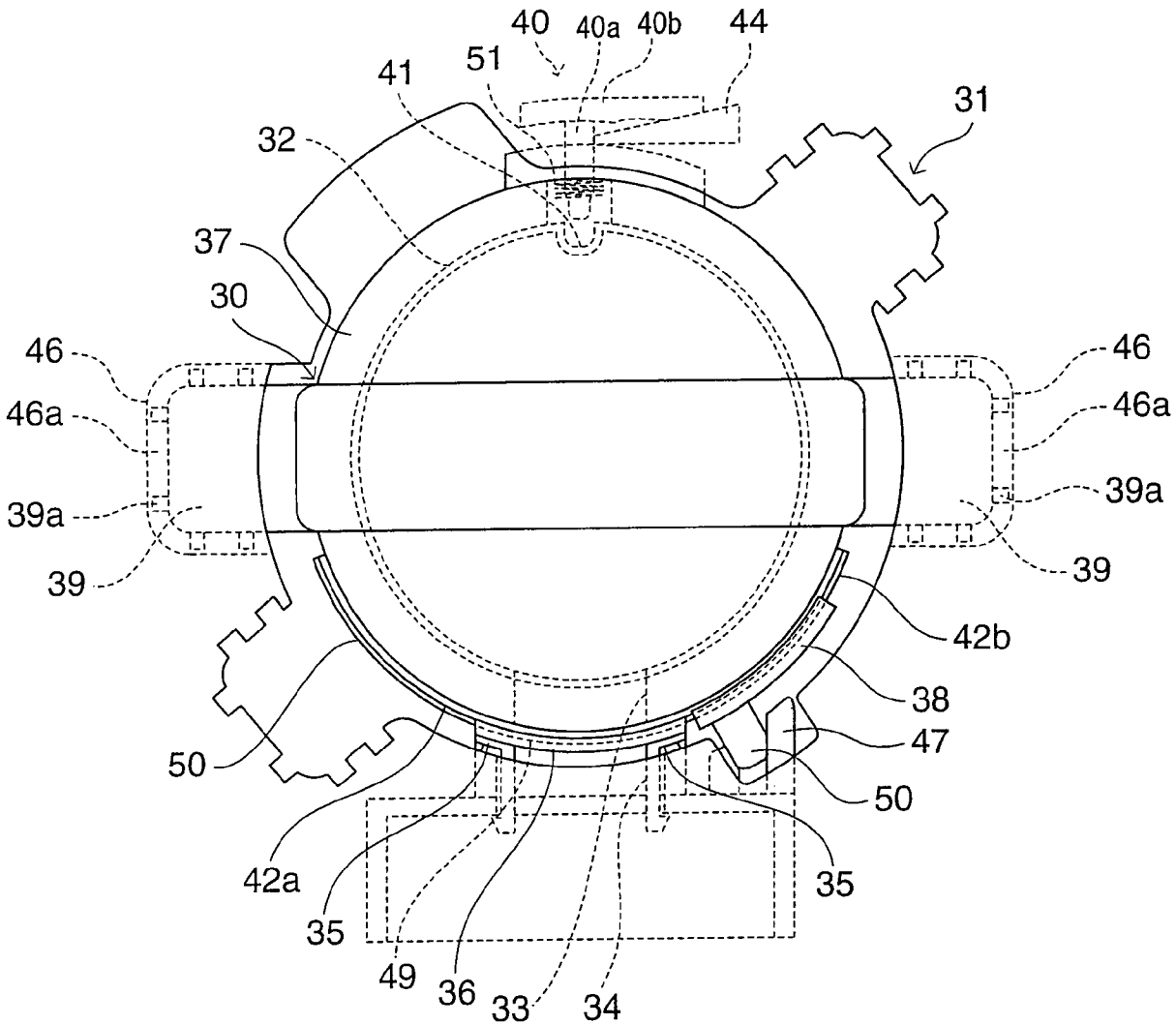
FIG. 7 is a front view illustrating a state in which the toner cartridge is rotated from the state shown in FIG. 6 thereby to be mounted in a predetermined position.
Figure 8:
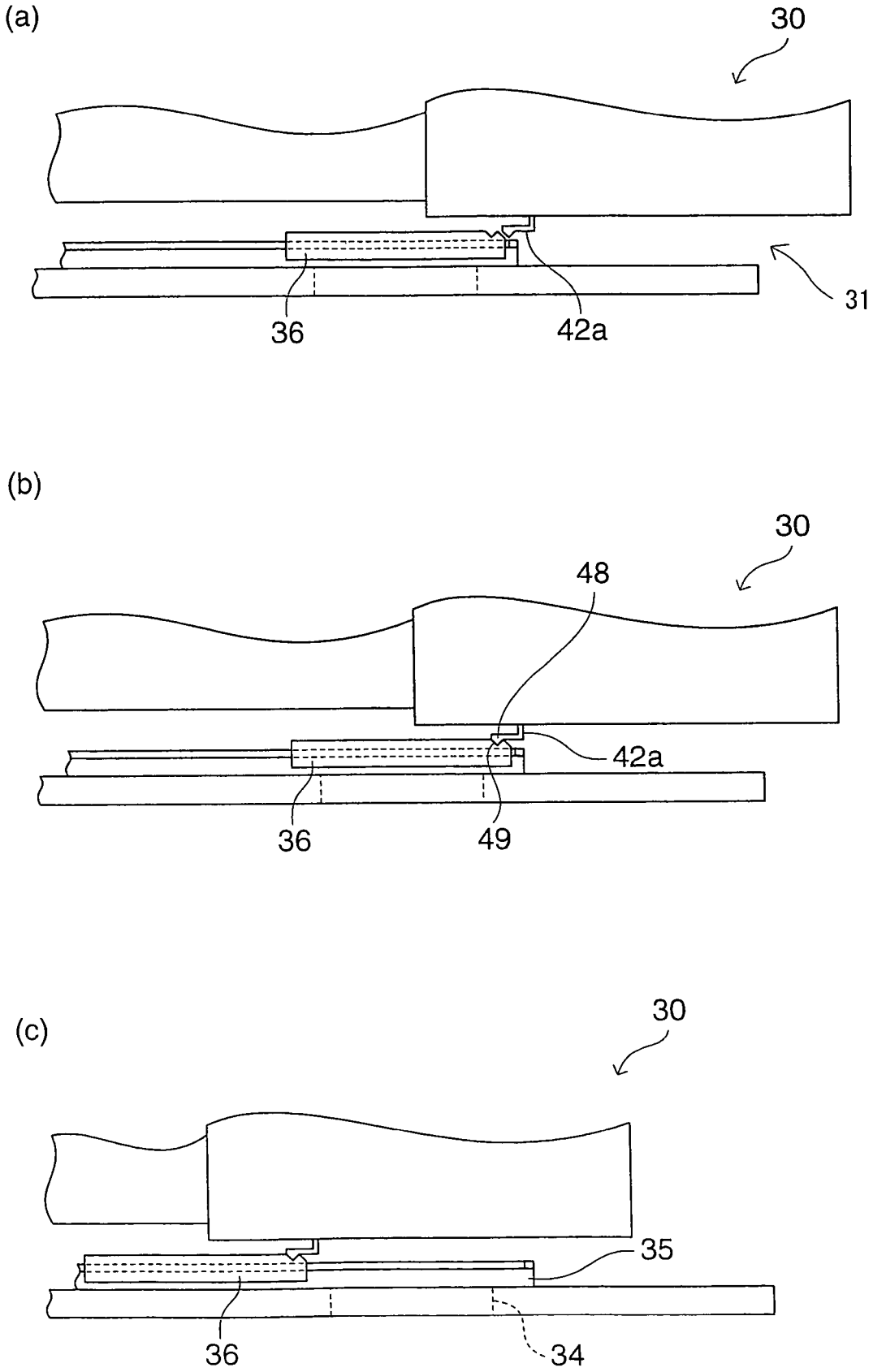
FIGS. 8(*a*) to 8(*c*) are diagrams for explaining how an inlet port shutter of a developing device is opened when the toner cartridge shown
Figure 9:
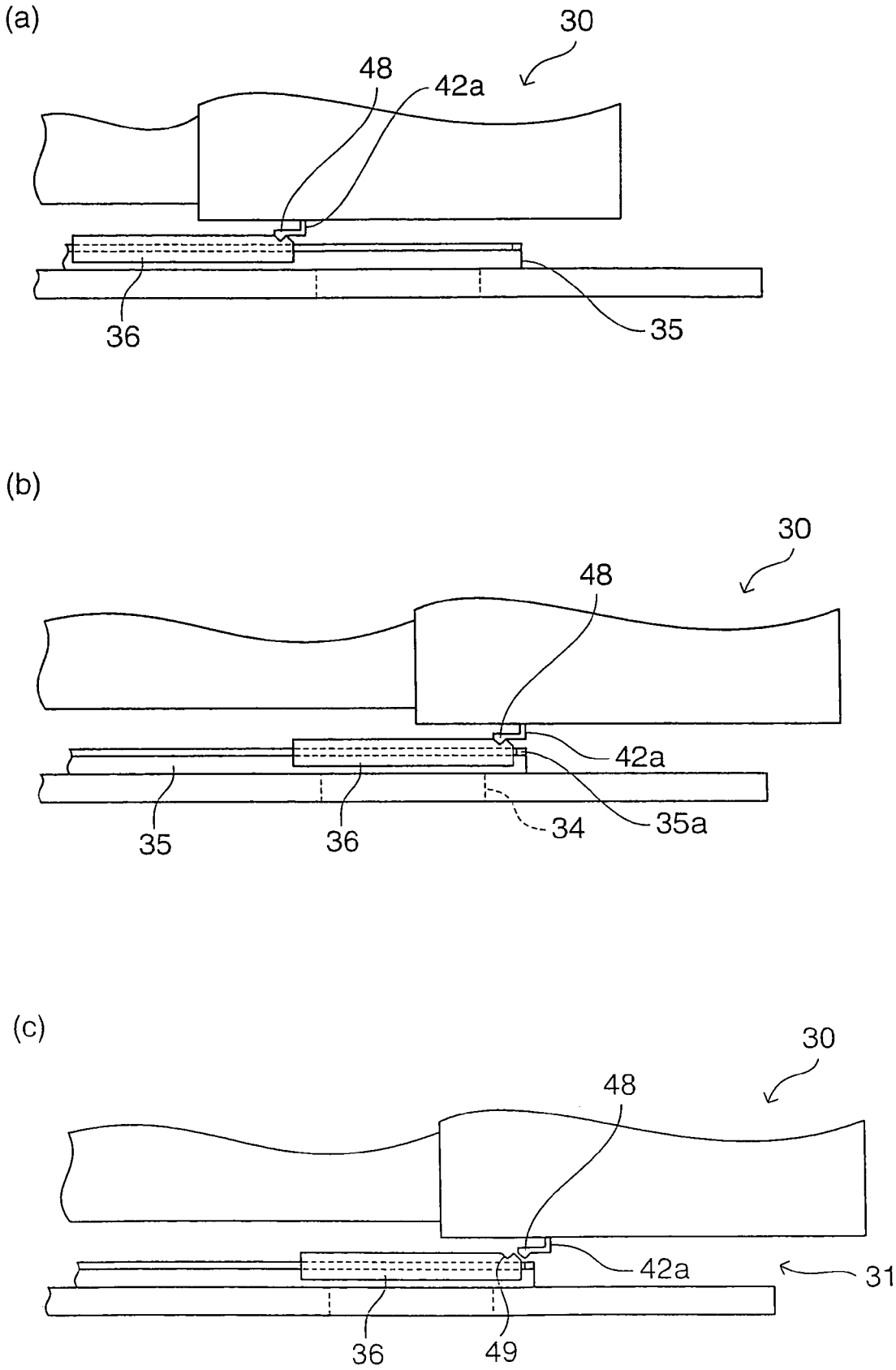
FIGS. 9(*a*) to 9(*c*) are diagrams for explaining how the inlet port shutter of the developing device is closed when the toner cartridge shown
Figure 10:
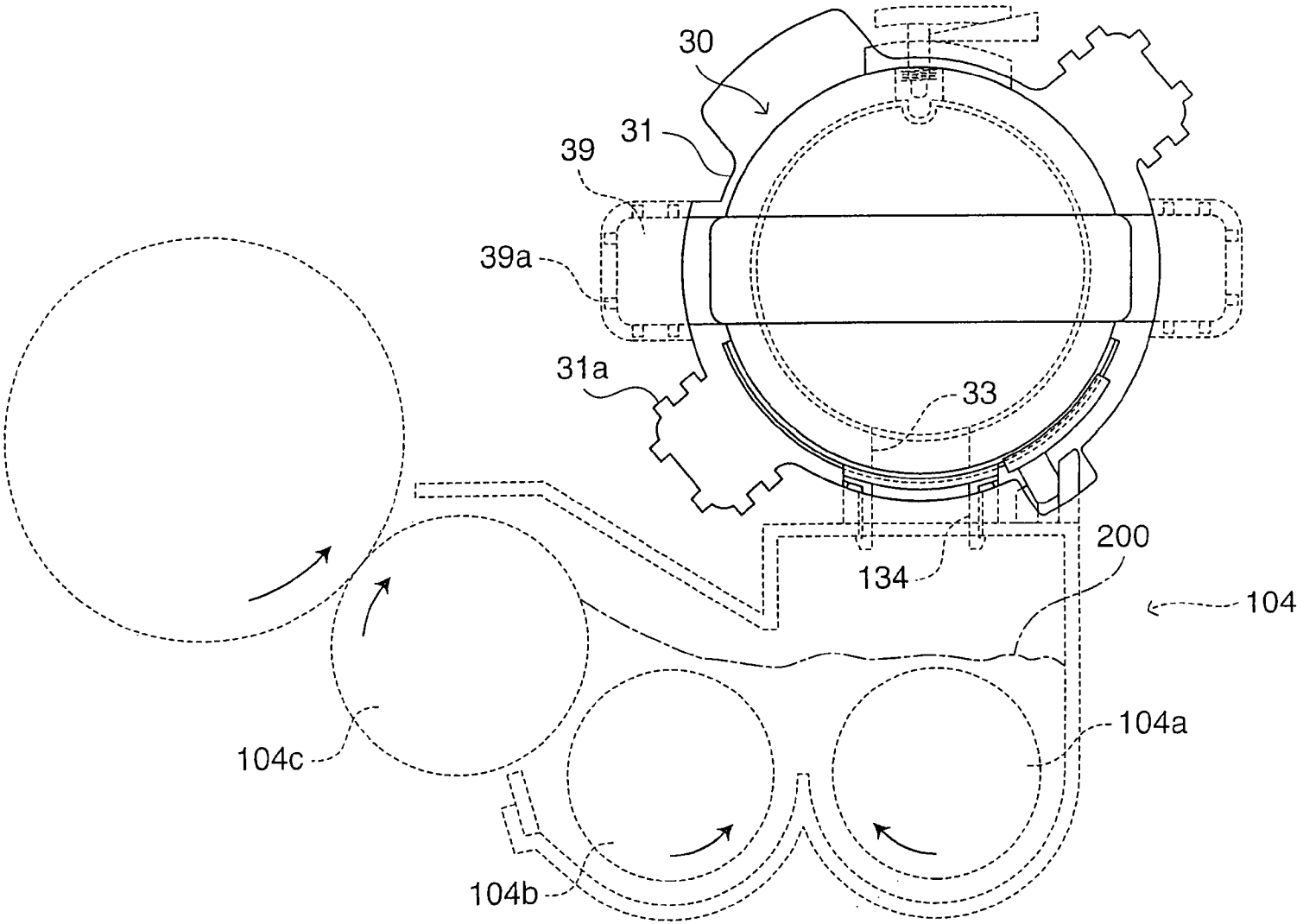
FIG. 10 is a diagram illustrating a modification of the embodiment in which toner is directly supplied to the developing device from the toner cartridge.

FIG. 1 is a schematic diagram illustrating the construction of a copying machine as the image forming apparatus according to the embodiment of the present invention and the toner cartridge according to the embodiment of the present invention. FIG. 2 is a perspective view of the toner cartridge shown FIG. 1. FIG. 3 is an enlarged view of major portions of the toner cartridge shown in FIG. 2. FIG. 4 is a perspective view illustrating a relationship between the toner cartridge shown FIG. 2 and a cartridge insertion port of the copying machine shown FIG. 1. FIG. 5 is an enlarged view of major portions of the cartridge insertion port shown in FIG. 4. FIG. 6 is a front view illustrating a state in which the toner cartridge shown FIG. 2 is inserted in the cartridge insertion port shown FIG. 4. FIG. 7 is a front view illustrating a state in which the toner cartridge is rotated from the state shown in FIG. 6 thereby to be mounted in a predetermined position. FIGS. 8(*a*) to 8(*c*) are diagrams for explaining how an inlet port shutter of a developing device is opened when the toner cartridge shown FIG. 2 is inserted into the cartridge insertion port shown FIG. 4. FIGS. 9(*a*) to 9(*c*) are diagrams for explaining how the inlet port shutter of the developing device is closed when the toner cartridge shown FIG. 2 is taken out of the cartridge insertion port shown FIG. 4. FIG. 10 is a diagram illustrating a modification of the embodiment in which toner is directly supplied to the developing device from the toner cartridge shown FIG. 2.

As shown in FIG. 1, the copying machine 100 according to this embodiment includes a toner hopper 8, a developing device 4, a photosensitive drum 1, a charging device 2, a laser exposure device 3, a transfer device 5, a sheet feeder 6 and a fixing device 7. The toner cartridge 30 is removably mounted in a cartridge insertion port 31.

The copying machine 100 is adapted to electrically charge the photosensitive drum 1 as an electrostatic latent image carrier by the charging device 2 and then form an electrostatic latent image on a surface of the photosensitive drum 1 by the laser exposure device 3.

In the developing device 4, toner supplied from the toner cartridge 30 through the toner hopper 8 is mixed with a carrier of iron powder with stirring by a stirring roller 4*a* to provide a two-component developing agent, which is in turn carried on a surface of a developer roller 4*b* having a plurality of magnetic fields to form a so-called magnetic brush.

When the magnetic brush formed on the surface of the developer roller 4*b* is brought into opposed relation to the photosensitive drum 1, negatively charged toner is transferred onto the photosensitive drum 1 to develop the electrostatic latent image into a toner image on the photosensitive drum 1. The toner image on the surface of the photosensitive drum 1 is transferred onto a paper sheet fed from the sheet feeder 6 by the transfer device 5. The toner image transferred onto the paper sheet is thermally fixed on the paper sheet in the fixing device 7, and the paper sheet is outputted to the outside.

A concentration sensor (not shown) for measuring the toner concentration of the developing agent is provided in the developing device 4. If the toner concentration is reduced to less than a predetermined concentration level, a stirring member 11 of the toner hopper 8 is driven to stir the toner for easy mixing of the toner with the developing agent and supply the toner into the developing device 4 via a feed roller 12.

A sensor (not shown) for measuring the amount of the toner in the toner hopper 8 is provided in the toner hopper 8. If the amount of the toner in the toner hopper 8 is reduced to less than a predetermined level, a rotation controller (not shown) drives a rotation driver (not shown) to rotate a toner bottle 32 (see FIG. 2) of the toner cartridge 30, thereby supplying the toner into the toner hopper 8 from a toner outlet port 33 (see FIG. 2) of the toner bottle 32. Thus, the toner concentration of the developing agent in the developing device 4 is constantly maintained within a predetermined range.

The structures of the toner cartridge 30 and the cartridge insertion port 31 of the copying machine 100 and how to mount and demount the toner cartridge 30 will hereinafter be described in detail.

As shown in FIG. 4, the toner cartridge 30, which is generally cylindrical and has a predetermined insertion direction, is removably mounted in the cartridge insertion port 31. The cartridge insertion port 31 has a toner inlet port 34 provided in an inner wall surface thereof in communication with the toner hopper 8 (see FIG. 1). The toner inlet port 34 is opened and closed by an inlet port shutter 36 which is slidable on two inlet port shutter rails 35 extending along opposite edges of the toner inlet port 34 in a toner cartridge insertion direction.

As shown in FIGS. 2 and 3, the toner cartridge 30 includes a hollow cylindrical toner bottle 32 which contains the toner, and a cylindrical support member 37 which supports the toner bottle 32 in an axially rotatable manner. The toner bottle 32 is formed of a polyethylene resin (soft resilient resin) by a blow molding method. The toner bottle 32 has a toner outlet port 33 provided in a peripheral surface portion thereof covered with the support member 37.

The support member 37 is molded from an acrylonitrile-butadiene-styrene (ABS) resin. A seal ring (not shown) having a V-shaped cross section and composed of a silicone rubber having a lower friction coefficient is provided between the toner bottle 32 and the support member 37 to seal a gap between the toner bottle 32 and the support member 37.

The toner bottle 32 has a plurality of transport ribs 32*a* provided on a peripheral surface thereof as projecting inward of the toner bottle 32 and helically extending toward the toner outlet port 33. The toner contained in the toner bottle 32 is transported toward the toner outlet port 33 by the function of the transport ribs 32*a* when the toner bottle 32 is rotatively driven.

As shown in FIGS. 3 and 4, the support member 37 has an outlet port shutter 38 provided slidably on an outer peripheral surface thereof for opening and closing the toner outlet port 33, and engagement portions 39 projecting from the outer peripheral surface thereof for positioning the cartridge 30 with respect to the cartridge insertion port 31 in the mounting of the toner cartridge 30. The support member 37 and the toner bottle 32 respectively have a projection and a recess serving as a locking portion 40 and a to-be-locked portion 41 (see FIG. 6) for restricting the rotation of the toner bottle 32 with respect to the support member 37 when the toner cartridge 30 is not mounted.

As shown in FIGS. 6 and 7, the locking portion 40 includes a lock pin 40*a* which extends through the support member 37 to be fitted in the to-be-locked portion 41 of the toner bottle 32, and a wedge-shaped action portion 40*b* which vertically moves the lock pin 40*a*. The lock pin 40*a* is biased toward the to-be-locked portion 41 by a resilient member 51. As shown in FIG. 7, a wedge-shaped disengaging member 44 is inserted below the action portion 40*b* when the support member 37 is rotated.

As shown in FIG. 3, the outlet port shutter 38 is slidable on two outlet port shutter rails 42*a*, 42*b* provided circumferentially on the outer peripheral surface of the support member 37 as extending in association with opposite edges of the toner outlet port 33. Of the two outlet port shutter rails 42*a*, 42*b*, the outlet port shutter rail 42*a* disposed on an inner side with respect to the toner cartridge insertion direction (see FIG. 4) has a greater length than the movable range of the outlet port shutter 38.

As will be described later in detail, the outlet port shutter rail 42*a* is brought into engagement with the inlet port shutter 36 to push and open the inlet port shutter 36 when the toner cartridge 30 is inserted as shown in FIG. 4.

As shown in FIG. 3, the engagement portions 39 each include a plurality of linear projections 39*a* provided on top and side faces thereof as each having a taper face 39*b* which has a height progressively increasing in the insertion direction. As will be described later in detail, this arrangement accurately and assuredly restricts a positional relationship between the toner cartridge 30 and the cartridge insertion port 31, when the toner cartridge 30 is inserted into the cartridge insertion port 31 as shown in FIG. 4. Further, this arrangement smoothly guides the engagement portions 39 to to-be-engaged portions 46 of the cartridge insertion port 31 to engage the engagement portions 39 with the to-be-engaged portions 46 at a higher level of positioning accuracy, when the engagement portions 39 are pivoted in a pivot groove 45 to positions associated with the to-be-engaged portions 46 by rotating the support member 37 and the toner cartridge 30 is moved in a direction opposite from the insertion direction by the biasing force of a resilient member 43 after the toner cartridge 30 is inserted into the cartridge insertion port 31.

As shown in FIG. 4, the resilient member 43 which biases the toner cartridge 30 in the direction opposite from the insertion direction and the disengaging member 44 which acts on the locking portion 40 for disengaging the locking portion 40 from the to-be-locked portion 41 in the mounting of the toner cartridge 30 are provided in the cartridge insertion port 31. Further, the pivot groove 45 in which the engagement portions 39 are pivoted, the to-be-engaged portions 46 to be engaged with the pivoted engagement portions 39 and a latching portion 47 which latches the outlet port shutter 38 are provided in the cartridge insertion port 31.

As shown in FIG. 5, the cartridge insertion port 31 has a plurality of grooves 31*a* which respectively receive the linear projections 39*a* of the engagement portions 39 (see FIG. 3). The grooves 31*a* respectively have inclined faces 46*a* provided in association with the taper faces 39*b* of the linear projections 39*a* (see FIG. 3) so as to be brought into intimate contact with the taper faces 39*b* when the engagement portions 39 are engaged with the to-be-engaged portions 46.

As shown in FIGS. 3 to 6, when the toner cartridge 30 is inserted into the cartridge insertion port 31 with the projections 39*a* of the engagement portions 39 fitted and positioned in the grooves 31*a* of the cartridge insertion port 31, an engagement projection 48 provided along an inner edge of the outlet port shutter rail 42*a* with respect to the toner cartridge insertion direction is engaged with an engagement groove 49 of the inlet port shutter 36, and the inlet port shutter 36 is pushed and slid on the inlet port shutter rails 35. Thus, the toner inlet port 34 is opened, and a projection 50 of the outlet port shutter 38 is engaged with the latching portion 47 of the cartridge insertion port 31.

More specifically, when the toner cartridge 30 is inserted into the cartridge insertion port 31, as shown in FIG. 8(*a*), the outlet port shutter rail 42*a* abuts against the inlet port shutter 36.

When the toner cartridge 30 is further pushed into the cartridge insertion port 31, as shown in FIG. 8(*b*), the engagement projection 48 of the outlet port shutter rail 42*a* is brought into engagement with the engagement groove 49 of the inlet port shutter 36 by resilient deformation of the outlet port shutter rail 42*a*. When the toner cartridge 30 is thereafter further pushed into the cartridge insertion port 31, the inlet port shutter 36 is pushed and slid on the inlet port shutter rails 35 by the outlet port shutter rail 42*a*, whereby the toner inlet port 34 is opened.

When the toner cartridge 30 is pushed toward the innermost end of the cartridge insertion port 31 against the biasing force of the resilient member 43 (see FIG. 4) and the support member 37 is rotated clockwise relative to the cartridge insertion port 31 by a predetermined angle as shown in FIG. 7 after the toner inlet port 34 is opened as described above, the wedge-shaped disengaging member 44 is inserted below the action portion 40*b* of the locking portion 40 to lift the lock pin 40*a*, whereby the locking portion 40 is disengaged from the to-be-locked portion 41. Thus, the toner bottle 32 is rotatable relative to the support member 37.

By rotating the support member 37, the outlet port shutter 38 with its projection 50 latched by the latching portion 47 is slid on the outlet port shutter rails 42*a*, 42*b* to be moved relative to the support member 37. Thus, the toner outlet port 33 is opened, and the engagement portions 39 are pivoted in the pivot groove 45 of the cartridge insertion port 31 (see FIG. 5) to the positions associated with the to-be-engaged portions 46.

Thereafter, the engagement portions 39 are brought into engagement with the to-be-engaged portions 46 by moving the toner cartridge 30 in the direction opposite from the insertion direction by the biasing force of the resilient member 43 (see FIG. 4). Thus, the toner cartridge 30 is properly positioned. At this time, the engagement portions 39 are smoothly guided to the to-be-engaged portions 46 and brought into engagement with the to-be-engaged portions 46 at a higher level of positioning accuracy, because the linear projections 39*a* have the taper faces 39*a* and the to-be-engaged portions 46 have the inclined faces 46*a* in association with the taper faces 39*a*.

With the toner cartridge 30 thus mounted in the predetermined position, the toner outlet port 33 communicates with the toner inlet port 34. Toner discharged from the toner outlet port 33 by the rotative driving of the toner bottle 32 is supplied into the toner hopper 8 (see FIG. 1) through the toner inlet port 34.

In the state shown in FIG. 7, a gap equivalent to the total height of the outlet port shutter rail 42*a*, 42*b* and the inlet port shutter rail 35 is defined between the toner outlet port 33 and the toner inlet port 34. This gap is sealed with resilient sealing members (not shown) respectively provided around the toner outlet port 33 and the toner inlet port 34, so that the toner discharged from the toner outlet port 33 is supplied into the toner inlet port 34 without leaking in the copying machine 100 (see FIG. 1).

When the toner cartridge 30 is taken out of the cartridge insertion port 31, the aforesaid steps are performed in the reverse order.

That is, the user pushes the toner cartridge 30 from the state shown in FIG. 7 against the biasing force of the resilient member 43 (see FIG. 4) to disengage the engagement portions 39 from the to-be-engaged portions 46, and then rotates the support member 37 counterclockwise relative to the cartridge insertion port 31 by a predetermined angle. At this time, the disengaging member 44 inserted below the locking portion 40 is disengaged from the action portion 40*b* of the locking portion 40, whereby the lock pin 40*a* is biased by the resilient member 51 and fitted in the to-be-locked portion 41. Thus, the locking portion 40 is engaged with the to-be-locked portion 41. Further, the outlet port shutter 38 with its projection 50 latched by the latching portion 47 is slid on the outlet port shutter rails 42*a*, 42*b* to be moved relative to the support member 37, whereby the toner outlet port 33 is closed. That is, the toner cartridge 30 is moved from the state shown in FIG. 7 to the state shown in FIG. 6.

When the toner cartridge 30 in the state shown in FIG. 6 is taken out of the cartridge insertion port 31, the inlet port shutter 36 engaged with the outlet port shutter rail 42*a* is slid on the inlet port shutter rails 35 to close the toner inlet port 34. In this state, the toner cartridge 30 is dragged out from the cartridge insertion port 31.

More specifically, as shown in FIG. 9(*a*), the inlet port shutter 36 engaged with the engagement projection 48 of the outlet port shutter rail 42*a* follows the movement of the toner cartridge 30 to be slid on the inlet port shutter rails 35. Thus, the toner inlet port 34 is closed as shown in FIG. 9(*b*). In this state, further sliding of the inlet port shutter 36 is restricted by stoppers 35*a* (see FIG. 5) provided at ends of the respective inlet port shutter rails 35.

When the toner cartridge 30 is further dragged out, as shown in FIG. 9(*c*), the engagement projection 48 of the outlet port shutter rail 42*a* is disengaged from the engagement groove 49 of the inlet port shutter 36 by resilient deformation of the outlet port shutter rail 42*a*. When the toner cartridge 30 is further dragged out, the toner cartridge 30 is taken out of the cartridge insertion port 31.

In this embodiment, the toner is supplied to the developing device via the toner hopper, but may be supplied directly to the developing device from the toner cartridge. A modification of the embodiment in which the toner is supplied directly to the developing device from the toner cartridge is shown in FIG. 10.

In the arrangement shown in FIG. 10, the toner cartridge 30 is mounted in an image forming apparatus with its toner outlet port 33 directed downward in the direction of gravity. The toner outlet port 33 of the toner cartridge 30 communicates with a toner inlet port 134 of a developing device 104. The toner discharged from the toner cartridge 30 is supplied directly into the developing device 104.

The developing device 104 includes a first stirring roller 104*a* and a second stirring roller 104*b*. A developing agent 200 is circularly transported within the developing device 104 by the first and second stirring rollers 104*a*, 104*b*. The toner falls from the toner outlet port 33 to be supplied into the developing device 104. The toner is first homogeneously mixed in the developing agent 200 with stirring by the first stirring roller 104*a*, and then transported to the vicinity of a developing roller 104*c* by the second stirring roller 104*b*.

The arrangement according to the modification shown in FIG. 10 allows for space saving without the need for the toner hopper 8 (see FIG. 1). Therefore, this arrangement is advantageous for a tandem color copying machine in which plural image forming units each including a toner cartridge, a developing device and a photosensitive drum for the respective colors (i.e., Y, M, C and K) are arranged in tandem.

Where Y-, M-, C- and K-toner cartridges 30 are used in the aforesaid color copying machine, linear projections 39*a* of the engagement portions 39 of the respective toner cartridges 30 and the grooves 31*a* of the corresponding cartridge insertion ports 31 may be configured in different ways. Thus, the respective toner cartridges 30 can be assuredly inserted into the corresponding cartridge insertion ports 31. Therefore, this arrangement is advantageous for prevention of erroneous insertion of the toner cartridges.

What is claimed is:

1. A toner cartridge to be removably mounted in an image forming apparatus including a cartridge insertion port for receiving the toner cartridge, the toner cartridge comprising:

a toner bottle which contains toner; and a support member which supports the toner bottle in an axially rotatable manner;

wherein the toner bottle has a toner outlet port provided in a portion thereof supported by the support member;

the support member has an outlet port shutter provided slidably on an outer surface thereof for opening and closing the toner outlet port, and a projecting engagement portion for positioning the toner cartridge with respect to the cartridge insertion port in the mounting of the toner cartridge;

the support member and the toner bottle respectively have a projection and a recess serving as a locking portion and a to-be-locked portion for restricting rotation of the toner bottle with respect to the support member when the toner cartridge is not mounted in the image forming apparatus and allowing the rotation of the toner bottle with respect to the support member and the projecting engagement portion when the toner cartridge is mounted in the image forming apparatus.

2. A toner cartridge as set forth in claim 1, wherein the support member is a cylindrical member covering one end portion of the toner bottle;

the engagement portion projects outward from a peripheral surface of the support member and extends in a toner cartridge insertion direction.

3. A toner cartridge as set forth in claim 1, wherein the engagement portion has a linear projection provided on a surface thereof as extending in the toner cartridge insertion direction.

4. A toner cartridge to be removably mounted in an image forming apparatus including a cartridge insertion port for receiving the toner cartridge, the toner cartridge comprising:

a toner bottle which contains toner; and a support member which supports the toner bottle in an axially rotatable manner;

wherein the toner bottle has a toner outlet port provided in a portion thereof supported by the support member;

the support member has an outlet port shutter provided slidably on an outer surface thereof for opening and closing the toner outlet port, and a projecting engagement portion for positioning the toner cartridge with respect to the cartridge insertion port in the mounting of the toner cartridge;

the support member and the toner bottle respectively have a projection and a recess serving as a locking portion and a to-be-locked portion for restricting rotation of the toner bottle with respect to the support member when the toner cartridge is not mounted in the image forming apparatus;

wherein the engagement portion has a linear projection provided on a surface thereof as extending in the toner cartridge insertion direction; and;

wherein the linear projection has a taper face which has a height progressively increasing in the toner cartridge insertion direction.

5. A toner cartridge to be removably mounted in an image forming apparatus including a cartridge insertion port for receiving the toner cartridge, the toner cartridge comprising:

a toner bottle which contains toner; and a support member which supports the toner bottle in an axially rotatable manner;

wherein the toner bottle has a toner outlet port provided in a portion thereof supported by the support member;

the support member has an outlet port shutter provided slidably on an outer surface thereof for opening and closing the toner outlet port, and a projecting engagement portion for positioning the toner cartridge with respect to the cartridge insertion port in the mounting of the toner cartridge;

the support member and the toner bottle respectively have a projection and a recess serving as a locking portion and a to-be-locked portion for restricting rotation of the toner bottle with respect to the support member when the toner cartridge is not mounted in the image forming apparatus wherein the support member has a first outlet port shutter rail and a second outlet port shutter rail for sliding the outlet port shutter, the first and second outlet port shutter rails each extending perpendicularly to the toner cartridge insertion direction, the first outlet port shutter rail being disposed inward of the second outlet port shutter rail with respect to the toner cartridge insertion direction, and having a greater length than a movable range of the outlet port shutter.

6. A toner cartridge as set forth in claim 5, wherein the first outlet port shutter rail has an engagement projection provided on an inner edge thereof with respect to the toner cartridge insertion direction.

7. A toner cartridge to be removably mounted in an image forming apparatus including a cartridge insertion port for receiving the toner cartridge, the toner cartridge comprising:

a toner bottle which contains toner; and a support member which supports the toner bottle in an axially rotatable manner;

wherein the toner bottle has a toner outlet port provided in a portion thereof supported by the support member;

the support member has an outlet port shutter provided slidably on an outer surface thereof for opening and closing the toner outlet port, and a projecting engagement portion for positioning the toner cartridge with respect to the cartridge insertion port in the mounting of the toner cartridge;

the support member and the toner bottle respectively have a projection and a recess serving as a locking portion and a to-be-locked portion for restricting rotation of the toner bottle with respect to the support member when the toner cartridge is not mounted in the image forming apparatus;

wherein the locking portion is provided on the support member, and the to-be-locked portion is provided on the toner bottle;

the locking portion includes a lock pin to be fitted in the to-be-locked portion of the toner bottle and a wedge-shaped action portion which vertically moves the lock pin.

8. An image forming apparatus comprising a cartridge insertion port for receiving a toner cartridge which includes a toner bottle containing toner and a support member supporting the toner bottle in an axially rotatable manner, the toner bottle having a toner outlet port provided in a portion thereof supported by the support member, the support member having an outlet port shutter provided slidably on an outer surface thereof for opening and closing the toner outlet port and a projecting engagement portion for positioning the toner cartridge with respect to the cartridge insertion port in mounting the toner cartridge, the support member and the toner bottle respectively having a projection and a recess serving as a locking portion and a to-be-locked portion for restricting rotation of the toner bottle with respect to the support member when the toner cartridge is not mounted in the image forming apparatus, wherein the cartridge insertion port includes a toner inlet port provided in an inner wall surface thereof for receiving toner supplied from the toner cartridge, an inlet port shutter provided slidably on the toner inlet port for opening and closing the toner inlet port, a resilient member which biases the toner cartridge in a direction opposite from a toner cartridge insertion direction, and a disengaging member which acts on the locking portion to disengage the locking portion from the to-be-locked portion in the mounting of the toner cartridge, and has a pivot groove in which the engagement portion is pivoted, a to-be-engaged portion to be engaged with the pivoted engagement portion, and a latching portion which latches a part of the outlet port shutter;

when the toner cartridge is inserted into the cartridge insertion port, the inlet port shutter is pushed and slid in releasable engagement with a part of the support member to open the toner inlet port, and the part of the outlet port shutter is latched by the latching portion of the cartridge insertion port;

when the toner cartridge is pushed into an innermost end of the cartridge insertion port against a biasing force of the resilient member and the support member is rotated by a predetermined angle in a predetermined direction with respect to the cartridge insertion port, the disengaging member acts on the locking portion to disengage the locking portion from the to-be-locked portion, whereby the outlet port shutter latched by the latching portion is moved relative to the support member to open the toner outlet port and the engagement portion is pivoted in the pivot groove of the cartridge insertion port to a position associated with the to-be-engaged portion;

when the toner cartridge is moved in the direction opposite from the insertion direction by the biasing force of the resilient member, the engagement portion is engaged with the to-be-engaged portion to position the toner cartridge in the cartridge insertion port.

9. An image forming apparatus as set forth in claim 8, wherein the engagement portion has a linear projection provided on a surface thereof as extending in the toner cartridge insertion direction, and the cartridge insertion port has a groove for receiving the linear projection.

10. An image forming apparatus as set forth in claim 9, wherein the linear projection has a taper face which has a height progressively increasing in the toner cartridge insertion direction, and the to-be-engaged portion has an inclined face provided in association with the taper face of the linear projection so as to be brought into intimate contact with the taper face when being engaged with the engagement portion.

11. An image forming apparatus as set forth in claim 8, wherein the support member has a first outlet port shutter rail and a second outlet port shutter rail for sliding the outlet port shutter, the first and second outlet port shutter rails each extending perpendicularly to the toner cartridge insertion direction, the first outlet port shutter rail being disposed inward of the second outlet port shutter rail with respect to the toner cartridge insertion direction, and having a greater length than a movable range of the outlet port shutter;

the first outlet port shutter rail has an engagement projection provided on an inner edge thereof with respect to the toner cartridge insertion direction, and the inlet port shutter has an engagement groove provided on an outer edge thereof with respect to the toner cartridge insertion direction for releasable engagement with the engagement projection of the first outlet port shutter rail.

12. An image forming apparatus as set forth in claim 8, wherein the locking portion is provided on the support member, and the to-be-locked portion is provided on the toner bottle;

the locking portion includes a lock pin to be fitted in the to-be-locked portion of the toner bottle through the support member, and a wedge-shaped action portion which vertically moves the lock pin;

the disengaging member has a wedge-shape so as to be inserted below the action portion when the support member is rotated.

* * * * *